US006017298A

United States Patent [19]

Baron

[11] Patent Number: 6,017,298

[45] Date of Patent: Jan. 25, 2000

[54] SPIRAL FOLDER

[75] Inventor: Michael P. Baron, Phoenix, Md.

[73] Assignee: Ward Holding Company, Wilmington, Del.

[21] Appl. No.: 09/141,912

[22] Filed: Aug. 28, 1998

[51] Int. Cl.[7] ..... B31B 1/28

[52] U.S. Cl. ..... 493/166; 493/436; 493/454; 493/179; 493/182

[58] Field of Search ..... 493/166, 179, 493/182, 436, 454, 178, 424, 442, 183, 161

[56] References Cited

U.S. PATENT DOCUMENTS

| | | | |
|---|---|---|---|
| 2,896,517 | 7/1959 | La Bombarde | 93/49 |
| 2,931,277 | 4/1960 | La Bombard | 93/52 |
| 2,986,078 | 5/1961 | Hottendorf | 93/52 |
| 4,254,692 | 3/1981 | Sardella | 493/179 |
| 4,624,653 | 11/1986 | McBride et al. | 493/179 |
| 5,114,392 | 5/1992 | McAdam, III et al. | 493/179 |
| 5,230,686 | 7/1993 | McAdam, III et al. | 493/179 |
| 5,827,162 | 10/1998 | Rubin et al. | 493/179 |

FOREIGN PATENT DOCUMENTS

| | | | |
|---|---|---|---|
| 514312 | 12/1930 | Germany | 81/9 |

*Primary Examiner*—Peter Vo
*Assistant Examiner*—Matthew Luby
*Attorney, Agent, or Firm*—Bartlett & Sherer; Ronald B. Sherer

[57] ABSTRACT

A machine for folding materials is disclosed in which the portion of the material is engaged and folded by a rotary cam such that the surface of the portion is engaged and not the edges of the portion. In the preferred embodiment, creasing rollers are positioned along the fold line above the rotary cam folders such that the fold is made very accurately.

17 Claims, 6 Drawing Sheets

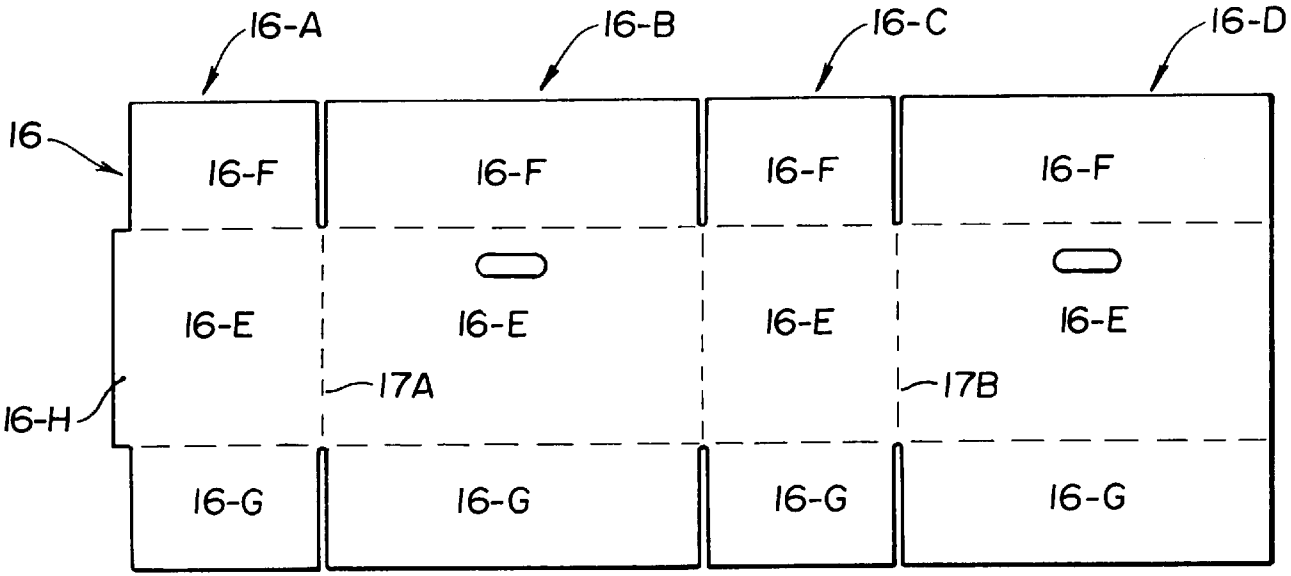
FIG. 2-A
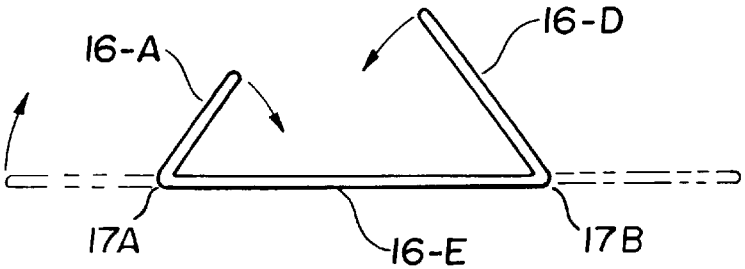
FIG. 2-B

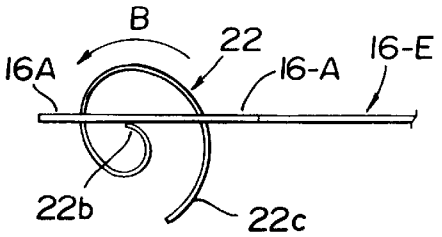
FIG. 6
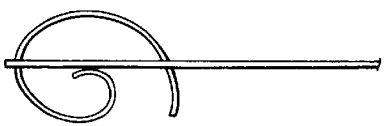
FIG. 7
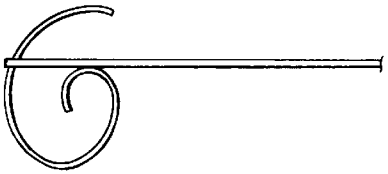
FIG. 8
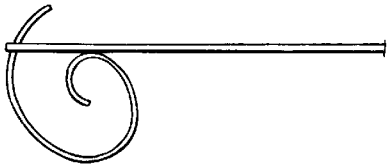
FIG. 9
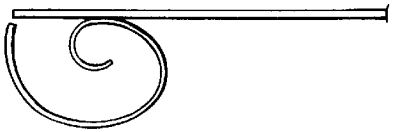
FIG. 10
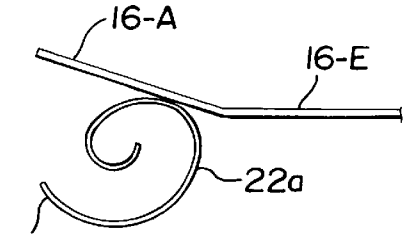
FIG. 11
FIG. 12
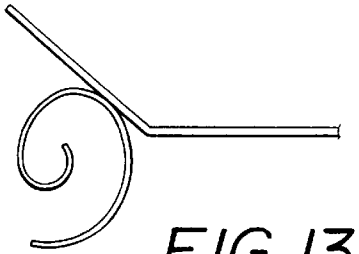
FIG. 13
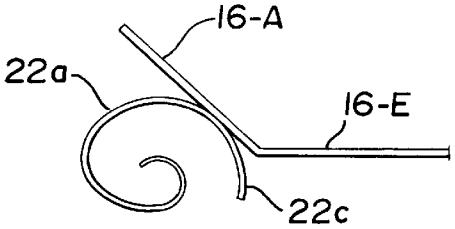
FIG. 14

STAGE I

STAGE II

STAGE III

STAGE IV

SPIRAL FOLDER

FIELD OF THE INVENTION

This invention relates to a machine for folding sheet materials, and particularly for folding corrugated cardboard sheets such as, for example, sheets of corrugated cardboard known as container blanks.

BACKGROUND

It is well known that some sheet materials are extremely difficult to fold in a precise and uniform manner along a predetermined fold line because the nature of the material deforms irregularly as the material is being folded. This problem is particularly severe in the case of cardboard sheets and corrugated cardboard sheets which tend to buckle at the fold line irregularly and cause the folded portion to become misaligned relative to the body portion of the sheet. In the case of corrugated blanks which have panels to be folded in order to form a container, the accuracy of the fold and the precise alignment of the folded panels is absolutely critical to the formation of a successful product. That is, any deformation or misalignment of the panels changes the shape of the container and may make it unacceptable. When folded in precise alignment, a container blank is said to be "square" or "squared".

This problem and the need to square each folded carton blank is discussed, for example, in U.S. Pat. No. 2,986,078 including illustrations of squared and skewed carton blanks, and this patent is hereby incorporated by reference.

Many attempts have been made to solve this problem, but none have totally eliminated the problem, and current speeds of folding up to 1,000 board feet per minute of cardboard blanks have made it even more difficult. All known prior attempts have utilized rods or belts to perform the folding action. These only make point or line contact with the flap of the panel, and the force is applied at an acute angle with respect to the fold line which is also the direction of travel of the blank. In addition, the initial contact of the rod or belt is with the leading edge of the flap. Both of these factors tend to bend the flap and/or twist it as the panel is being folded. Thus, there remains a critical need for a high-speed folder which can produce highly squared container blanks with a substantially lower product rejection rate.

SUMMARY

The present invention provides an elongated spiral-shaped folding cam which has a solid surface of revolution. As the spiral-shaped cam rotates about its longitudinal axis, the solid surface engages the surface of the entire panel, rather than just the edge of the flap such that the panel is not bent or twisted during the folding. Also, the folding machine of the present invention may include a set of creasing rollers which crease the blank along the fold line before and/or during the folding action of the spiral folding cam.

BRIEF DESCRIPTION OF THE DRAWINGS

FIG. 2-A is a top plan view of a typical container blank to be folded;

FIG. 2-B is a schematic elevational view of one container blank showing the panels being folded;

FIGS. 6 to 14 are schematic sectional illustrations showing the rotary positions of the first stage of spiral folding cam as it folds one panel of the container blank.

DETAILED DESCRIPTION

Figure 1:
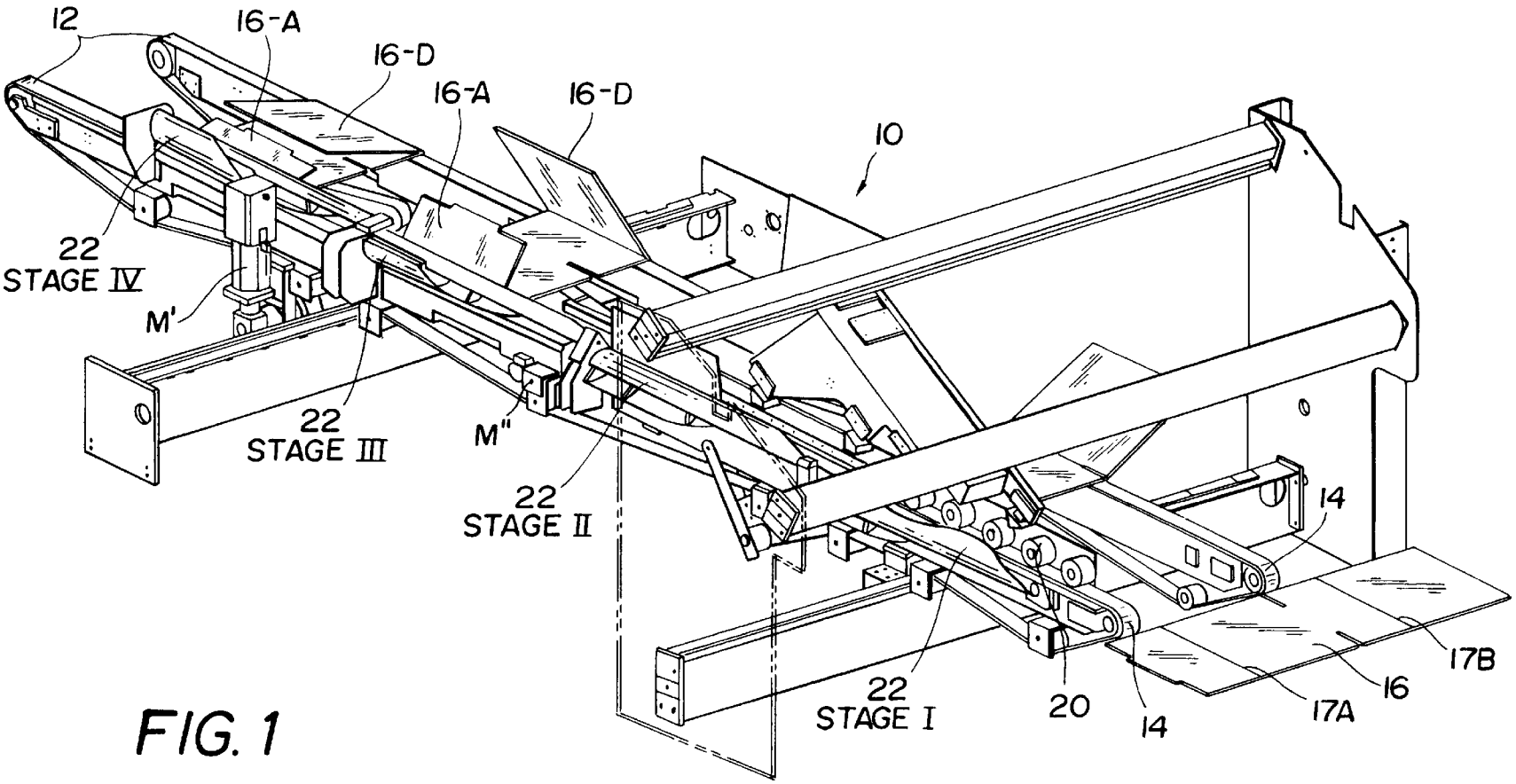
FIG. 1 is a simplified and schematic perspective view of the spiral folding machine of the present invention.

Referring to FIG. 1, the folding machine 10 of the present invention preferably comprises a pair of spaced-apart conveyors 12 having conveyor belts 14 which convey individual sheets of material 16 to be folded in the direction of arrow A. Belts 14 are driven by motors M' and, as previously discussed, sheets 16 may be composed of any difficult to fold material. However, solely for purposes of illustration of the complex structure and mode of operation of the present invention, sheets 16 will be described as comprising sheets of corrugated cardboard to be folded since corrugated sheets are particularly difficult to fold precisely and accurately along a predetermined fold line as previously described.

For purposes of clarifying the terminology used in the corrugated container industry, FIGS. 2-A and 2-B illustrate a sheet of corrugated board 16 which is designed to become a container of articles. The sheet is generally referred to in the art as a container blank, and container blank 16 includes four panels 16A–D. Each of panels 16A–D comprises a body portion 16E and a leading flap 16F and a trailing flap 16G. Typically, the container blank also includes a pre-glued tab 16H which will engage panel 16D and permanently connect panels 16A and 16D when panels 16A and 16D are folded along fold lines 17A and 17B. However, the folds along lines 17A and 17B must be extremely precise or the four panels will not be square and the completed container will not accept the intended articles.

Figure 3:
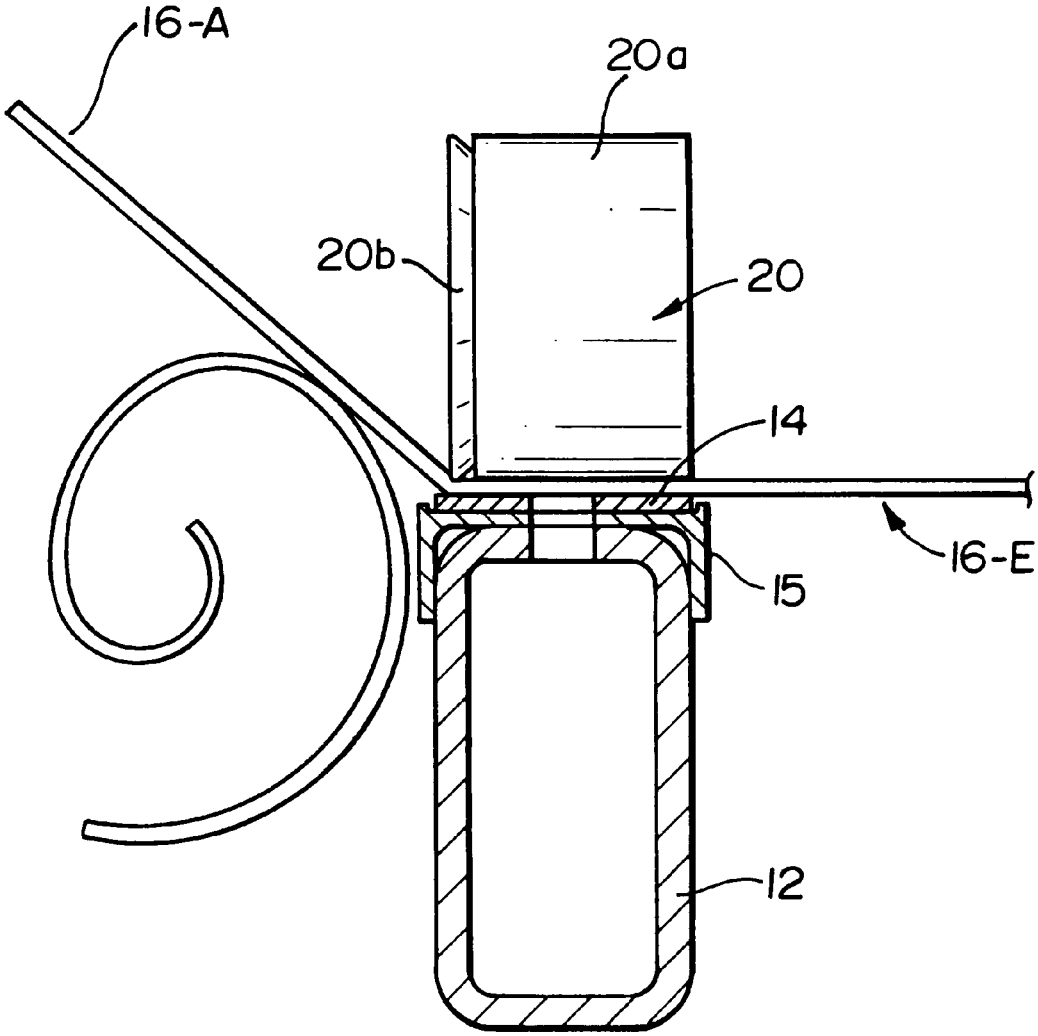
FIG. 3 is a simplified and schematic sectional view showing the cooperation of the spiral folding cam below the panel and one creasing roller above the container blank.

As the blanks enter the folding machine, the upper surfaces of the blanks may be engaged by a series of creasing rollers 20. These are shown in FIGS. 1 and 3 illustrating one preferred embodiment of the present invention. These creasing rollers are aligned along the lines of the proposed fold; i.e., along fold lines 1A and B. As each of the blanks progresses into the folding machine, the panels 16A and 16D are progressively engaged by a series of rotating folding cams 22. Four of cams 22 are illustrated on the left side of the folding machine in FIG. 1, and it will be understood that an additional four folding cams are located on the right side. It will also be understood that the folding cams are driven through suitable gearing by motors M". While more or less than four stages of folding may be employed, it has been discovered that four stages of folding is preferred. For example, it has been discovered that if each folding stage folds the respective panel by about 20 to 40 degrees, and preferably 25 to 35 degrees, and most preferably 30 degrees, then the panels are folded in the order of 80 to 160 degrees, and more preferably in the order of 100 to 140 degrees, and most preferably by about 120 degrees. Stated otherwise, it has been discovered that it is the very initial contact and very initial folding action which is most critical in successfully obtaining a precise and squared fold. Therefore, while the rotary folding cams of the present invention may be used to fold the panels by the complete 180 degrees required for the finished product, it has been discovered that the most cost-efficient practice of the invention is to utilize the present invention in several stages so as to fold each panel in the order of only 80 to 140 degrees, and then utilize conventional rods or other means to complete the folding of each panel to be 180 degrees from its starting position such as to become parallel to the panel over which it is being folded.

From the foregoing brief description of the schematic views shown in FIGS. 1, 2A and 2B, it will be understood that, as each of blanks 16 passes through the multiple stages of folding machine 10, each of panels 16A and 16D is progressively folded upwardly and toward the center of the blank as shown in FIG. 2-B, or completely such that panels 16A and 16D are parallel to panels 16B and 16C, respectively.

One embodiment of creasing rollers 20 are schematically illustrated in FIG. 3 wherein numeral 12 represents the left one of the spaced-apart conveyor supports carrying conveyor belt 14. Preferably, a low-friction guide 15 may be positioned between the support and the conveyor belt. Belt 14 conveys the left side of the container blank which includes side panel 16A. As blank 16 is conveyed into the folding machine, its upper surface becomes engaged by the series of creasing rollers 20 as previously stated. It will be noted that each of rollers 20 has a cylindrical body portion 20*a* which engages the blank and holds the blank securely against the conveyor belt. Preferably, each of rollers 20 also includes an annular rim portion 20*b* which has a diameter larger than that of the body portion. The cross-sectional shape of the rim portion 20*b* is generally an annular V-shape with the bottom of the "V" being blunt and smooth so as not to tear or otherwise damage the container blank. As a result, rim portion 20*b* presses down into the blank and creases, or further creases the pre-creased blank precisely along the intended fold line before the blank reaches the first stage of folding, and also during the initial stage or stages of the folding action. In this regard, it has been discovered that the severe problems in folding corrugated cardboard precisely along a predetermined fold line are substantially solved when the corrugated blank is creased by the creasing rollers before the folding action begins, and the creasing rollers continue their creasing action during the folding action, whether or not the fold line may have been pre-creased in the preceding stage. Of course, it will be understood that roller body portion 20*a* and rim portion 20*b* may be mounted on separate shafts, and that these portions may be supported and positioned against the upper surface of the blanks by separate support mechanisms. Also, it is to be understood that, for purposes of creasing the blanks, it is rim portion 20*b* with its annular V-shaped cross-section engaging the blanks which performs the creasing function, and that other means such as solid rollers, belts, rods, etc. may be utilized to perform the hold-down function of body portion 20*a*.

Figure 4:
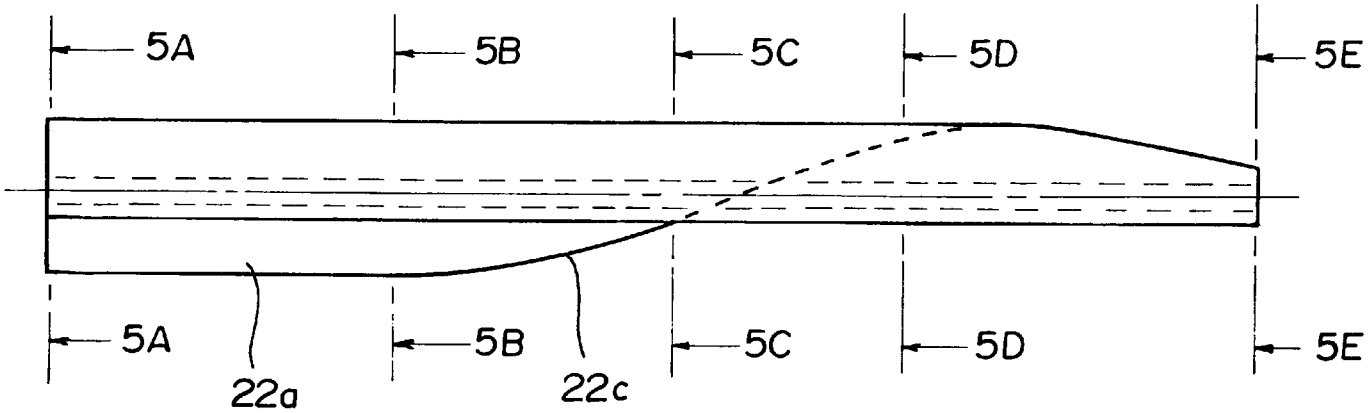
FIG. 4 is a schematic top plan view of one spiral folding cam.
Figure 5E:
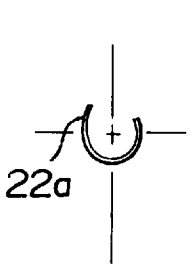
FIGS. 5A to 5E are sectional views taken along view lines A–E of FIG. 4.
Figure 5D:
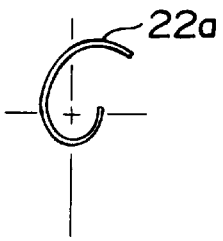
Figure 5C:
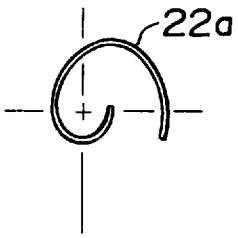
Figure 5B:
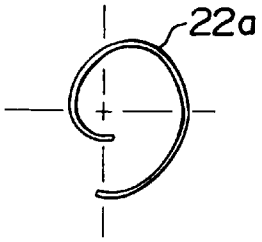
Figure 5A:
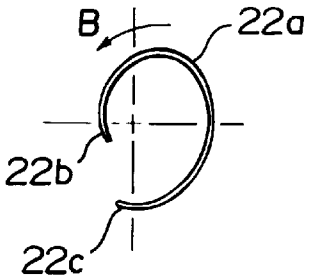
Figure 15A:
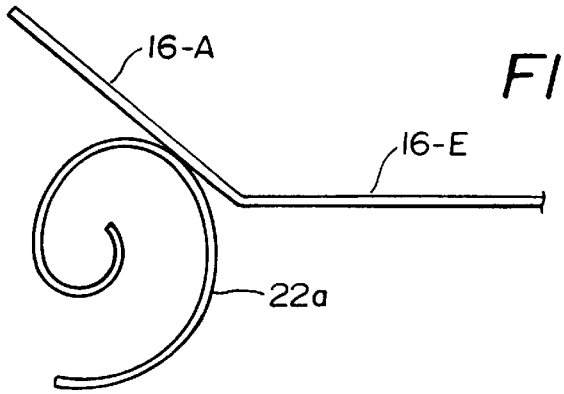
FIGS. 15A to 15D are schematic illustrations showing the folding of one panel as the container blank passes through four stages of spiral folding cams.
Figure 15B:
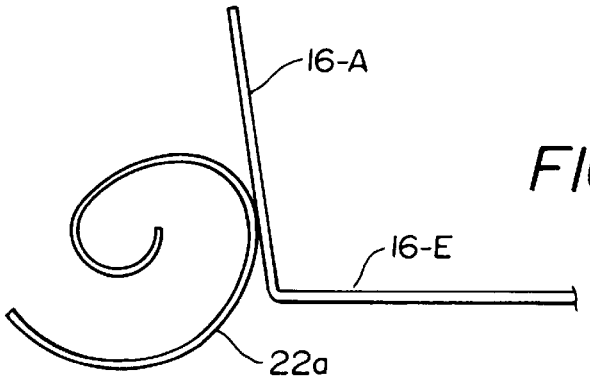
Figure 15C:
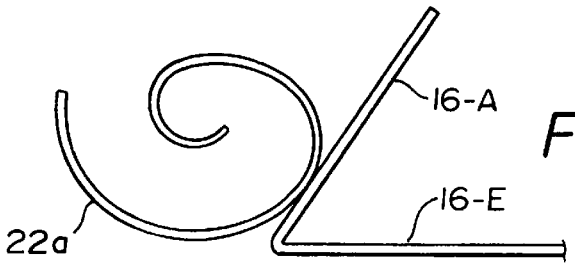
Figure 15D:
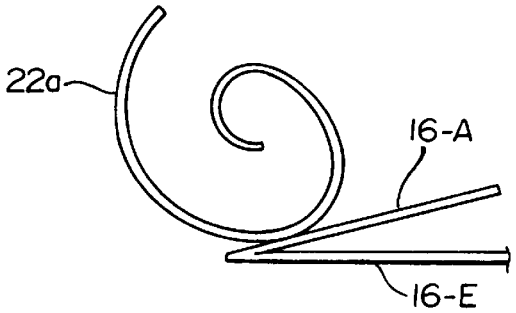

The details of the shape and operation of rotating spiral cam folders 22 will now be described with reference to FIGS. 4–14. FIG. 4 is a top plan view of one spiral cam, and FIGS. 5A to 5E show the cross-sections of the cam at five locations along the axial length of the cam folder. The cam folder has an outer, solid surface of revolution 22*a* which extends the full axial length of the folding cam, and it is this solid surface of revolution 22*a* which contacts the panels to be folded. As shown in FIGS. 4 and 5A, the folding cam has a leading edge 22*b* and a trailing edge 22*c* neither of which contact leading flap 16F of panel 16A to be folded. Also, it will be noted from FIGS. 5A–5E that all of the cross-sections of the folding cam are of spiral shapes of different radii.

FIGS. 6–14 illustrate the rotary positions of the folding cams in the first folding stage as the panel of one container blank passes over the folding cam. FIGS. 6–9 illustrate four rotary positions of the cam as a blank approaches the elongated cam and passes over the small end portion of the cam. In these approach positions, the panel is above that portion of the spiral-shaped cam which is of constant radius and it will be noted that the cam is rotating in counter-clockwise direction shown by arrow B. As a result, the panel of the carton blank remains horizontal as shown since the folding action has not yet begun.

Referring to FIG. 10, the spiral-shaped folding cam is shown as it is about to begin the folding action. In this position, it will be noted that trailing edge 22*c* has rotated below the level of the carton blank; i.e., below the board line, so that the blank may continue to pass over the smaller diameter portions of the cam folder. Also, it will be noted that the panel is being engaged by the last portion of the spiral surface having the constant radius, and the panel is about to be engaged by portions of the folding cam having a progressively greater radius. Thus, as shown in FIGS. 11–13, outer solid surface 22*a* of the spiral-shaped cam continues to increase the folding action on the panel as the panel is engaged by the progressively larger diameter portions of the folding cam. By way of example of one preferred embodiment, the angular portion of the spiral surface which is of progressively increasing diameter is preferably in the order of 130° to 145°. Thereafter, as shown in FIGS. 13 and 14, the panel is engaged by the solid surface portion 22*a* which is of the maximum and constant diameter. This constant diameter portion of the spiral folder holds the panel in its partially folded position, and sets the fold as illustrated in FIGS. 13 and 14 as the blank continues to be moved forward by the conveyor into the second stage of the folding machine.

The folding action of folding cams 22 in stages II, III and IV is the same as that previously described, except that, each succeeding stage increases the angle of the fold until the last stage completes the fold with the panels 16A and 16D lying in the order of 100 or more degrees from the initial horizontal position as illustrated in FIGS. 15A–15D. Also, it will be understood that the preferred embodiment includes motor controls which coordinate the position of each blank by timing the conveyor motor M' with the timing of motors M" which control the angular position of each rotary cam.

As shown in FIGS. 1 and 15A–15D, each of the folding stages II–IV is positioned higher than the preceding stage, and each succeeding stage is also positioned closer to the center of the container blank. As a result, while each of the spiral folding cams is of the same shape and dimensions, the panels of the container blanks may be folded precisely and over an angle of 120 or more degrees from the horizontal position illustrated in FIG. 1. Throughout the folding process, it will be noted that none of the spiral folding cams 22 ever contact the leading edge of the blank or any portion of leading flaps 16F of the blank. Rather, all contact with the panels of the blanks is made by the solid and continuous outer surface of revolution 22*a* of the spiral folders 22. Also, the direction of the force applied to the panels by surface 22*a* is entirely perpendicular to the fold line and the direction of travel of the blank. As a result, the blanks are not skewed or bent by contact of their leading edges or leading flaps, and moreover, the force of the folding action is uniformly distributed along the surface of the entire panel by the solid surface of revolution of the spiral folding cams. Thus, the blanks are folded precisely squarely even at the very high production speeds of the production machines which may precede the folding section.

It will be understood that the foregoing description of one embodiment is intended to be illustrative of the invention, rather than exhaustive thereof, and it will become apparent to those skilled in the folding art that many revisions and modifications may be made in the embodiment as illustrated. Accordingly, it is to be understood that the true invention is not intended to be limited other than as expressly set forth in the following claims.

What is claimed is:

1. A folding machine for folding panel portions of blanks of sheet material comprising:

(a) conveyor means for conveying the blanks of sheet material through said folding machine in a travel direction, each of said blanks including at least one panel portion to be folded;

(b) a plurality of rotary cams positioned to engage and fold said panel portion;

(c) drive means for rotating said rotary cams; and (d) each of said rotary cams being of a spiral cross-sectional shape, and including a solid surface of revolution, and in which the radii of the spiral cross-sections increase in said direction of travel, and being positioned relative to said conveyor means so as to engage and fold said panel portion with said solid surface of revolution.

2. The folding machine of claim 1 including a plurality of rollers, said rollers being positioned above said blanks and engaging the upper surface of said blanks.

3. The folding machine of claim 2 wherein said rollers include a rim portion, and wherein the diameter of said rim portion is sufficient to crease the blanks along the line of proposed folding.

4. The folding machine of claim 3 including a body portion of said roller, and wherein said body portion is comprised of compressible material.

5. A folding machine for folding individual sheets of cardboard comprising:

(a) conveyor means for conveying said sheets through said folding machine in a travel direction;

(b) said sheeting having a first portion and a second portion to be folded;

(c) folder means for engaging said second portions to be folded and folding them relative to said first portion said folder means having spiral cross-sections of increasing area in said travel direction;

(d) a plurality of roller means positioned above said sheets for urging said sheets downwardly against said conveyor means;

(e) said roller means including annular rim portions, and the diameters of said rim portions being sufficient to engage and crease said blanks during folding of said second portions by said folder means.

6. The folding machine of claim 5 wherein said roller means include portions composed of resilient material, and wherein said rim portions are composed of non-resilient material.

7. The folding machine of claim 5 wherein said folder means comprises a solid surface of revolution which engages and folds said second portion to be folded without engaging any other portion of said second portion.

8. The folding machine of claim 5 wherein said folder means comprise an elongated spiral-shaped body having an outer solid surface which engages and folds said second portion to be folded.

9. The folding machine of claim 5 wherein said folder means comprise a plurality of individual folding stages, and wherein said individual folding stages are spaced along the direction of travel of said sheets.

10. The folding machine of claim 9 wherein each succeeding folding stage along said direction is positioned higher than the preceding folding stage and closer to the center of the sheets.

11. A rotary folder for folding a first portion of a sheet of corrugated cardboard material relative to a second portion of said corrugated sheet material as the sheet travels through said folder in a travel direction, said sheet including a surface portion and a leading edge portion, said rotary folder comprising:

(a) an axis of rotation;

(b) rotary cam means forming an elongated solid surface of revolution about said axis; and (c) said rotary cam means having a spiral cross-section of increasing radii in the direction of travel of the sheet such that said solid surface of revolution engages the surface portion of said first portion and folds it relative to said second portion without engaging the edge portions of said sheet.

12. The folder of claim 11 in combination with a plurality of other rotary folders, and wherein each of said other rotary folders are the same as recited in claim 11.

13. The plurality of rotary folders of claim 12 wherein each of said folders comprise a folding stage, and wherein said folding stages are positioned along a line of travel of said sheet such as to sequentially fold said sheet.

14. The plurality of rotary folders of claim 13 wherein each folding stage is positioned above the preceding stage and close to the center of said sheet.

15. The rotary folder of claim 11 in combination with a plurality of creasing means for creasing said sheet, and wherein said creasing means are positioned above said sheets and said rotary cam means are positioned below said sheet.

16. The rotary folder of claim 11 wherein said first portions of said corrugated cardboard comprises a panel of a container blank to be folded to form a corrugated container.

17. The rotary folder of claim 15 wherein said creasing means comprise a plurality of circular means, and wherein said circular means include V-shaped annular edges for creasing said sheet.

* * * * *